US007163176B1

(12) United States Patent
Geswender et al.

(10) Patent No.: US 7,163,176 B1
(45) Date of Patent: Jan. 16, 2007

(54) 2-D PROJECTILE TRAJECTORY CORRECTION SYSTEM AND METHOD

(75) Inventors: Chris E. Geswender, Tucson, AZ (US); Andrew J. Hinsdale, Oro Valley, AZ (US); George A. Blaha, Tucson, AZ (US); Richard Dryer, Oro Valley, AZ (US)

(73) Assignee: Raytheon Company, Waltham, MA (US)

( * ) Notice: Subject to any disclaimer, the term of this patent is extended or adjusted under 35 U.S.C. 154(b) by 297 days.

(21) Appl. No.: 10/758,522

(22) Filed: Jan. 15, 2004

(51) Int. Cl.
*F42B 10/32* (2006.01)

(52) U.S. Cl. ..... 244/3.27; 244/3.1; 102/490; 102/400

(58) Field of Classification Search ..... 244/3.1, 244/3.21–3.29, 3.3; 102/400, 490, 529
See application file for complete search history.

(56) References Cited

U.S. PATENT DOCUMENTS 3,358,559 A * 12/1967 Grandy ..... 89/1.818
3,504,869 A 4/1970 Evans
3,759,466 A 9/1973 Evers
4,013,245 A 3/1977 Vanbuskirk
4,113,204 A * 9/1978 Leek ..... 244/3.21
4,149,166 A 4/1979 Null
4,175,720 A * 11/1979 Craig ..... 244/3.28
4,389,028 A * 6/1983 Kalivretenos et al. ..... 244/3.21
4,512,537 A 4/1985 Sebestyen et al.
5,379,968 A 1/1995 Grosse
5,398,887 A * 3/1995 Wassom et al. ..... 244/3.22
5,507,452 A 4/1996 Mayersak
5,512,537 A 4/1996 Tsang
5,542,864 A 8/1996 Pebbles et al.
5,657,947 A 8/1997 Mayersak
5,707,029 A * 1/1998 McIntosh ..... 244/225
5,762,291 A 6/1998 Hollis et al.
5,775,636 A 7/1998 Vig et al.
5,788,180 A * 8/1998 Sallee et al. ..... 244/3.21
5,816,531 A 10/1998 Hollis et al.
5,826,821 A 10/1998 Brandon et al.
5,886,257 A 3/1999 Gustafsen et al.
6,073,880 A * 6/2000 Voigt et al. ..... 244/3.28
6,135,387 A 10/2000 Seidel et al.
6,168,111 B1 * 1/2001 Kayser et al. ..... 244/3.29
6,202,958 B1 * 3/2001 Dommer et al. ..... 244/3.28
6,234,082 B1 5/2001 Cros et al.
6,283,407 B1 9/2001 Haceknesch
6,310,335 B1 10/2001 Bonnet et al.
6,325,325 B1 12/2001 Bonnet et al.
6,345,785 B1 2/2002 Harkins et al.

(Continued)

*Primary Examiner*—Timothy D. Collins
(74) *Attorney, Agent, or Firm*—Horace St. Julian; Leonard A. Alkov; Karl A. Vick

(57) ABSTRACT

A 2-D correction system uses intermittent deployment of aerodynamic surfaces to control a spin or fin stabilized projectile in flight; correcting both crossrange and downrange impact errors. Intermittent surface deployment develops rotational moments, which create body lift that nudge the projectile in two-dimensions to correct the projectile in its ballistic trajectory. In low spin rate projectiles ("fin stabilized"), the rotational moment directly produces the body lift that moves the projectile. In high spin rate projectiles ("spin stabilized"), the rotational moment creates a much larger orthogonal precession that in turn produces the body lift that moves the projectile. The aerodynamic surfaces are suitably deployed over multiple partial roll cycles at precise on (deployed) and off (stowed) positions in the cycle to nudge the projectile up or down range or left or right cross range until the desired ballistic trajectory is restored.

43 Claims, 10 Drawing Sheets

U.S. PATENT DOCUMENTS 6,454,205 B1 * 9/2002 Niemeyer et al. ..... 244/3.26
6,474,593 B1 * 11/2002 Lipeles et al. ..... 244/3.21
6,502,785 B1 * 1/2003 Teter et al. ..... 244/3.22
6,502,786 B1 1/2003 Rupert et al.
6,511,016 B1 * 1/2003 Bar et al. ..... 244/3.24
6,588,700 B1 * 7/2003 Moore et al. ..... 244/3.28
6,604,705 B1 * 8/2003 Pellegri et al. ..... 244/3.24
6,616,093 B1 * 9/2003 Albrektsson et al. ..... 244/3.23
6,666,402 B1 * 12/2003 Rupert et al. ..... 244/3.27
6,883,747 B1 * 4/2005 Ratkovic et al. ..... 244/3.15
6,905,093 B1 * 6/2005 Dryer et al. ..... 244/3.28
2001/0039898 A1 * 11/2001 Bar et al. ..... 102/501
2002/0117580 A1 * 8/2002 Rupert et al. ..... 244/3.24
2002/0190155 A1 12/2002 Lipeles
2003/0037665 A1 * 2/2003 Rupert et al. ..... 89/1.8
2004/0108412 A1 * 6/2004 Moore et al. ..... 244/3.24

* cited by examiner

2-D PROJECTILE TRAJECTORY CORRECTION SYSTEM AND METHOD

BACKGROUND OF THE INVENTION

1. Field of the Invention

This invention relates to launched projectiles in general, and specifically to a two-dimensional correction system and method for correcting the range and deflection errors in an unguided spin or fin stabilized projectile.

2. Description of the Related Art

Modern warfare is based on mission speed, high per round lethality, and low possibility of collateral damage. This requires high precision. Unguided artillery shells follow a ballistic trajectory, which is generally predictable but practically results in larger misses at ranges greater than 20 miles due to variations in atmospheric conditions; wind speed and direction, temperature and precipitation, and variations in the weapons system; manufacturing tolerances, barrel condition, propellant charge temperature and gun laying errors. As the ballistic range increases, the potential impact of the projectile variation grows until the projectile delivered lethality is too low to effectively execute the fire mission.

Precision in such weapons comes at a high cost. Fully guided rounds such as ERGM, XM982 and AGS LRLAP cost $25,000.00 to $40,000.00 a piece. These solutions are essentially a gun-fired guided missile that uses GPS/IMU technology to precision guide the missile to the target. Such high cost systems are not feasible to modify the millions of artillery rounds in the existing inventory or to be integrated into the design of new artillery rounds.

What is needed is a system that can provide in-flight projectile trajectory correction more simply and less expensively than a guided projectile. Preferably the system can be used to modify the existing inventory. The system should be safe from electronic jamming, which is likely in a combat environment. The system should improve accuracy so that the corrected projectiles can be used effectively for targets at ranges in excess of 20 miles.

There are a number of possible implementations that have been developed, typically as modifications to the fuze kit. These fall into the following categories of a 1D corrector; a kit that corrects either Down Range errors or Cross Range Errors or a 2D corrector, a kit that corrects both Down and Cross Range errors. Additionally, the 2D correctors can be implemented as a body fixed kit (where the kit rolls with the projectile body) or as a de-coupled kit, where the kit roll rate is different than the projectile body. The de-coupled 2D kit requires a roll bearing to de-couple the two elements.

The 1D Down Range corrector works by estimating the downrange decrement given that a brake is deployed to increase projectile drag and alter the ballistic trajectory of the projectile. This is a one time deployment decision. If atmospheric conditions change, the brake cannot adjust. The brake is easy to implement but also suffers in that cross range errors (~100 m DEP) are not reduced. The brake requires a slight change to the ballistic firing tables because the projectile must be aimed past the target. The brake is compatible with TRUTH (current projectile location) being supplied by either GPS or a Data Link from an external tracking source. See U.S. Pat. No. 6,310,335 for an example of a 1D Down Range corrector.

The 1D Cross Range corrector works by estimating the cross range adjustment possible if a reduction in the projectile average roll rate is implemented to alter the ballistic trajectory of the projectile. This is a one time deployment decision. If atmospheric conditions change, the system cannot adjust. A one-time deployment of a fin or canard is easily implemented but suffers in that down range errors (>100 m REP) are not reduced. A slight change to the ballistic firing tables are required because the projectile must be aimed left of but closer to the intended target. This approach is compatible with TRUTH being supplied by either GPS or a Data Link from an externally tracking source.

The two above concepts can be used together to implement a 2D corrector to alter the projectile's ballistic trajectory (see U.S. Pat. No. 6,502,786). Each mechanism independently implements the appropriate deployment decision. Each individually is a one time deployment decision. If atmospheric conditions change after deployment, the system cannot adjust. This is an easily implementable system but suffers in that it requires a substantial change to the ballistic firing tables to be used operationally.

The de-coupled 2D corrector works by estimating both the down range and cross range adjustment possible if a change in the average projectile body angle of attack is implemented. This can be a continuous correction. These systems suffer in that the de-coupling mechanism is bulky and the fuze outer mold line cannot follow the NATO STANAG shapes such that new and different ballistic firing tables are required to be used operationally. This system is also compatible with TRUTH being supplied by either GPS or a Data Link from and externally tracking source. See U.S. Pat. Nos. 5,512,537; 5,775,636 and 5,452,864 for examples of 2D Cross Range correctors.

There remains an acute and present need to provide a 2-D corrector for accurately correcting both the range and deflection errors inherent in an unguided spin stabilized projectile without having to modify the ballistic firing tables. The corrector should be simple, reliable, low power and inexpensive and capable of being retrofit to existing projectiles.

SUMMARY OF THE INVENTION

The present invention provides a 2-D correction system for accurately correcting both the range and deflection errors inherent in an unguided spin or fin stabilized projectile that can be used with existing ballistic firing tables and retrofitted to existing projectiles.

This is accomplished by intermittently deploying aerodynamic surfaces to develop a rotational moment, which create body lift that nudge the projectile in two-dimensions to correct the projectile in its ballistic trajectory. In low spin rate projectiles ("fin stabilized"), the rotational moment directly produces the body lift that moves the projectile. In high spin rate projectiles ("spin stabilized"), the rotational moment creates a much larger orthogonal precession that in turn produces the body lift that moves the projectile.

The aerodynamic surfaces are suitably deployed over multiple partial roll cycles at precise on (deployed) and off (stowed) positions in the cycle to nudge the projectile up or down range or left or right cross range until the desired ballistic trajectory is restored. Full downrange and cross-range control in all directions allows for the use of existing firing tables. A fuze kit can be modified with a simple deployment mechanism and a pair of canards to retrofit existing projectiles. The 2-D corrector can be implemented as a body fixed or de-coupled kit, fixed or variable canard angle or attack, fixed or proportional canard deployment, continuous or windowed control to target, and forebody, mid-body or tail canard placement.

In an exemplary embodiment, a body fixed 2-D corrector includes a pair of pivot mounted canards and a deployment mechanism such as a voice coil with a centripetal spring incorporated into a modified fuze kit for attachment to a standard projectile. The canards are held at a fixed angle of attack and are either stowed or fully deployed. When stowed, the canards do not affect the ballistic trajectory. When deployed the canards create the rotational moment, hence lift that nudge the projectile. A TRUTH receiver such as GPS or a data link is incorporated into the kit's electronics to provide the current position of the projectile. A flight computer estimates deviations in the cross range and down range vectors to target are detected soon after launch and apogee, respectively, determines precisely when and how many times the canards must be deployed and stowed in partial roll cycles and controls the deployment mechanism accordingly. The flight computer may maintain continuous control to target of the intermittent deployment to keep the projectile on its ballistic trajectory or may make windowed adjustments early on for crossrange variations, after apogee for downrange variations and then once again at a certain time to target for both cases if required by a power budget.

These and other features and advantages of the invention will be apparent to those skilled in the art from the following detailed description of preferred embodiments, taken together with the accompanying drawings, in which:

DETAILED DESCRIPTION OF THE INVENTION

The present invention provides a 2-D correction system for accurately correcting both the range and deflection errors inherent in an unguided spin or fin stabilized projectile (artillery shells, missiles, EKVs) that can be used with existing ballistic firing tables and retrofitted to existing projectiles. This is accomplished by intermittently deploying aerodynamic surfaces to develop a rotational moment, which creates body lift that nudges the projectile in two-dimensions to return the projectile to its ballistic trajectory. In spin stabilized projectiles, the rotational moment causes a much larger orthogonal precession, which in turn moves the projectile. The aerodynamic surfaces are suitably deployed over multiple partial roll cycles at precise on (deployed) and off (stowed) positions in the cycle to nudge the projectile up or down range or left or right cross range until the desired ballistic trajectory is restored.

Figure 1:
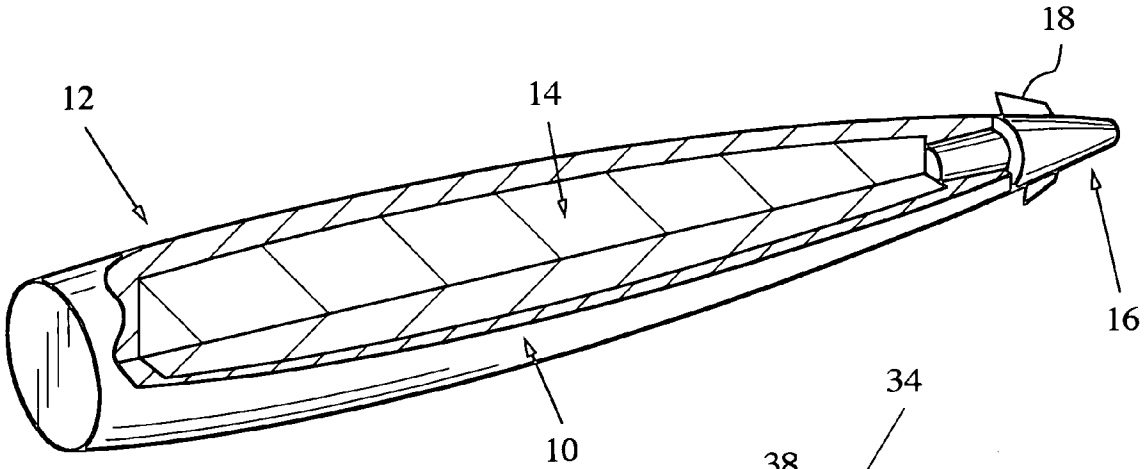
FIG. 1 is a perspective view of an artillery shell having a modified fuze kit with a 2-D body fixed correction system in accordance with the present invention.

As shown in FIG. 1, an unguided spin stabilized projectile 10 includes a steel housing 12 and an explosive payload 14. A fuze kit 16 is threaded onto the housing. A standard fuze kit includes a fuse, a safe and arm mechanism, battery, an initialization coil and a flight computer. High spin rate projectiles are stabilized gyroscopically, i.e. by the spinning of the projectile itself. Low spin rate projectiles are stabilized by the addition of fins to the airframe. As modified to provide 2-D correction, the fuze kit includes at least one canard 18 (shown here in deployed position), a deployment mechanism and a TRUTH receiver for providing the position and velocity vector of the projectile on its ballistic trajectory to the target. In general, this design allows different types of fuse kits, e.g. timed fuses, impact fuse, and delayed impact fuses, to be used with a standard housing and payload. The incorporation of the 2-D correction in the fuze kit allows the millions of projectiles in inventory to be easily retrofit. The 2-D corrector can be implemented as a body fixed or de-coupled kit, fixed or variable canard angle or attack, fixed or proportional canard deployment, continuous or windowed control to target, and forebody, mid-body or tail canard placement.

As illustrated in section views of a modified fuze kit 16 (FIGS. 2*a*–2*b*) and a system block diagram (FIG. 3), modified fuze kit 16 includes the standard functionality provided by an initialization coil 20, an HOB sensor 22, a flight computer 24, a detonator 26, a safe and arm device 28, a booster charge 30, and a battery 32. Initialization coil 20 serves as an AC-coupled input port through which an artilleryman can quickly, roughly and safely program the fuze detonation instructions into the flight computer 24. For example, detonate on impact, detonate x seconds prior to impact, detonate when altitude is less than y feet, etc. HOB sensor 22 provides the information, e.g. altitude, to the flight computer that initiates the detonation sequence. The illustrated projectile, as is typical of most projectiles, includes three separate explosive charges: the payload 14, detonator 26, which is a primer charge that does not have enough energy to set off the payload, and a booster charge 30 that does have enough energy to ignite the payload. To prevent accidental detonation, the detonator 26 and booster charge 30 are separated by the safe and arm device 28. Ordinarily, the safe and arm device is rotated ninety degrees to isolate the detonator 26 from the booster charge 30. The flight computer initiates detonation by rotating the safe and arm device thereby providing a channel from the detonator to the booster charge. Immediately thereafter, the flight computer sets off detonator 26 sending sparks and flame through the safe and arm device to set off booster charge 30, which in turn burns hot and with sufficient energy to ignite the payload 14.

The modified fuze kit 16 further includes at least one pivot mounted canard 18 and a deployment mechanism 34. Flight computer 24 is provided with a TRUTH receiver 25, e.g. a GPS receiver, and programmed to execute a flight control algorithm to control the intermittent deployment of canards 18 to nudge the projectile to its ballistic trajectory.

Figure 2A:
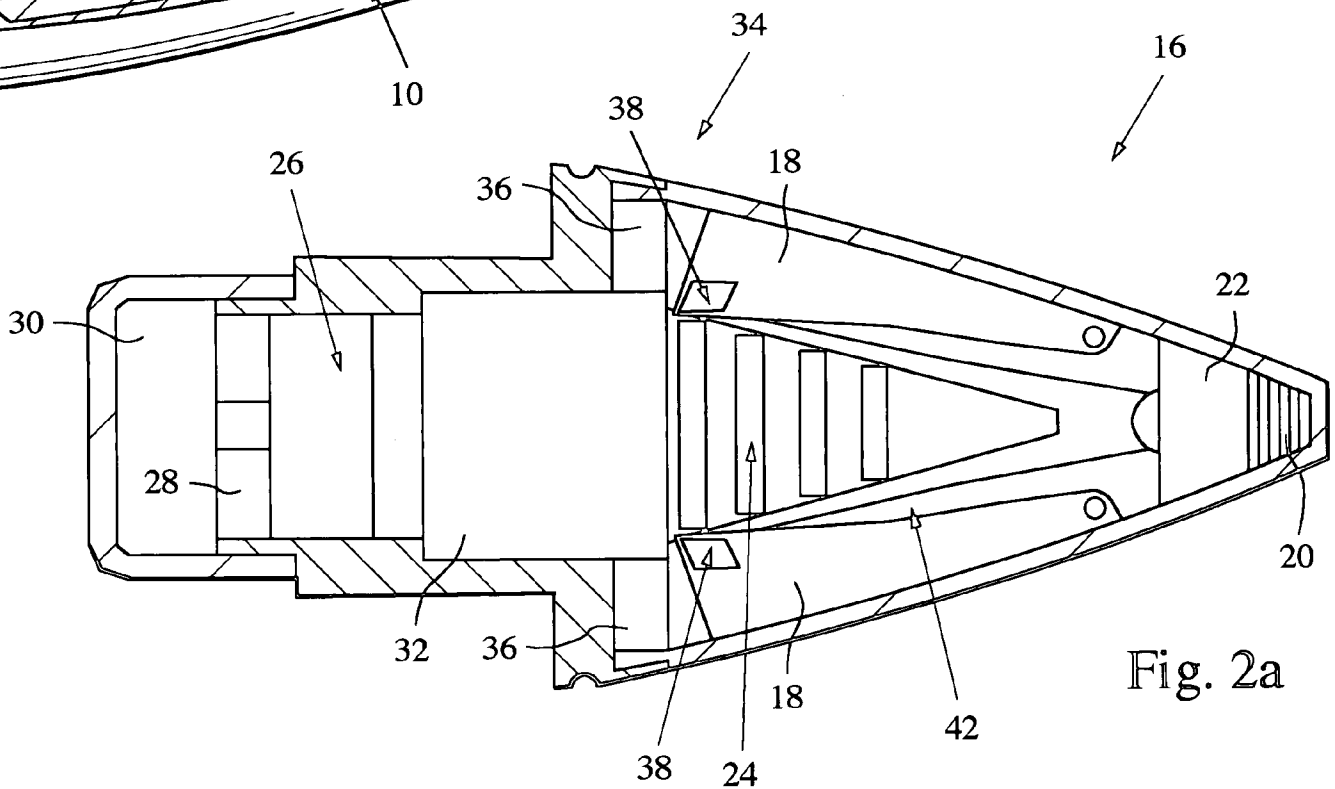
FIGS. 2*a* and 2*b* are section views of the modified fuze kit illustrating voice coil and centripetal spring mechanisms for intermittently deploying the canards to provide two-dimensional correction.
Figure 2B:
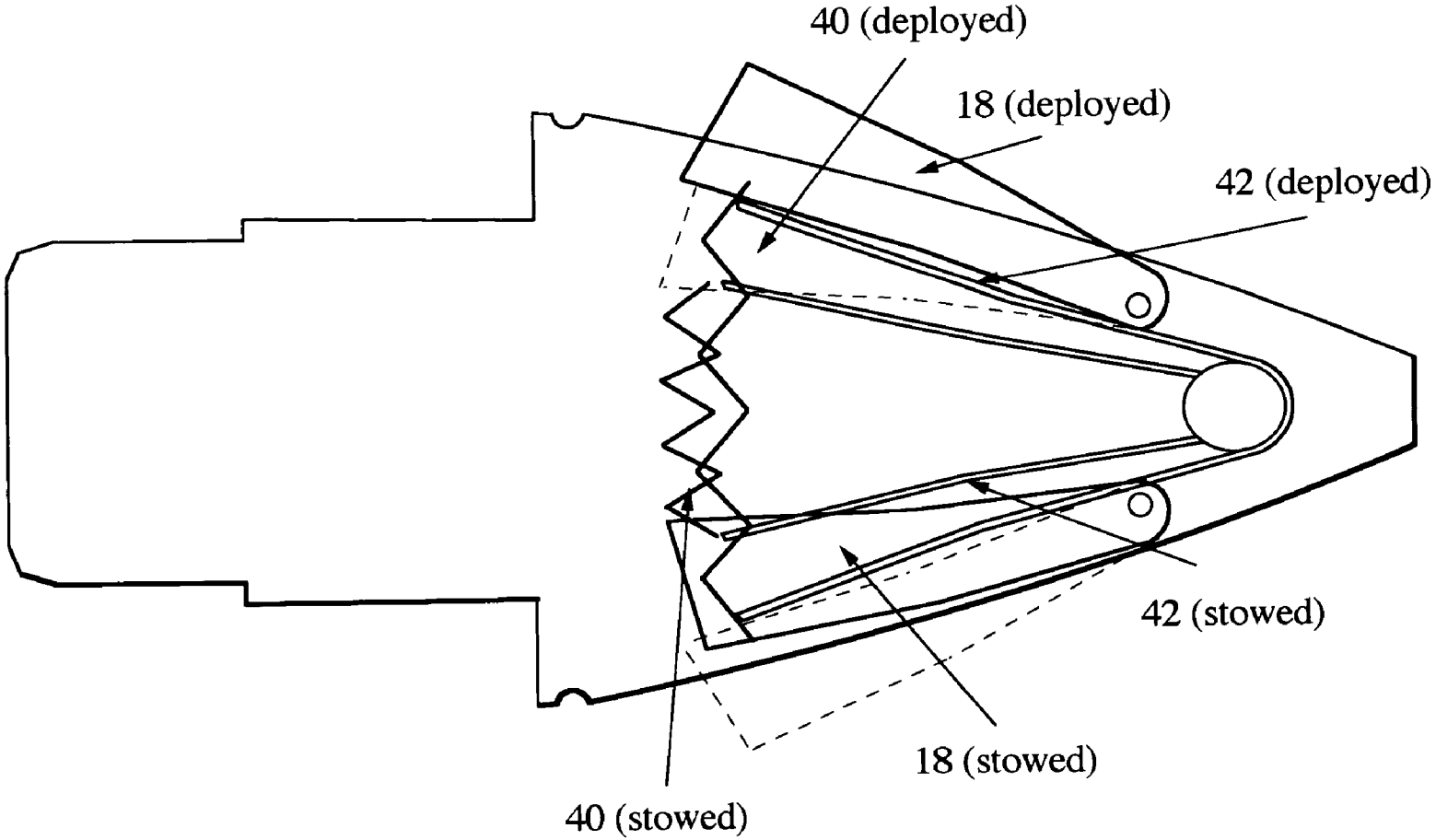
Figure 3:
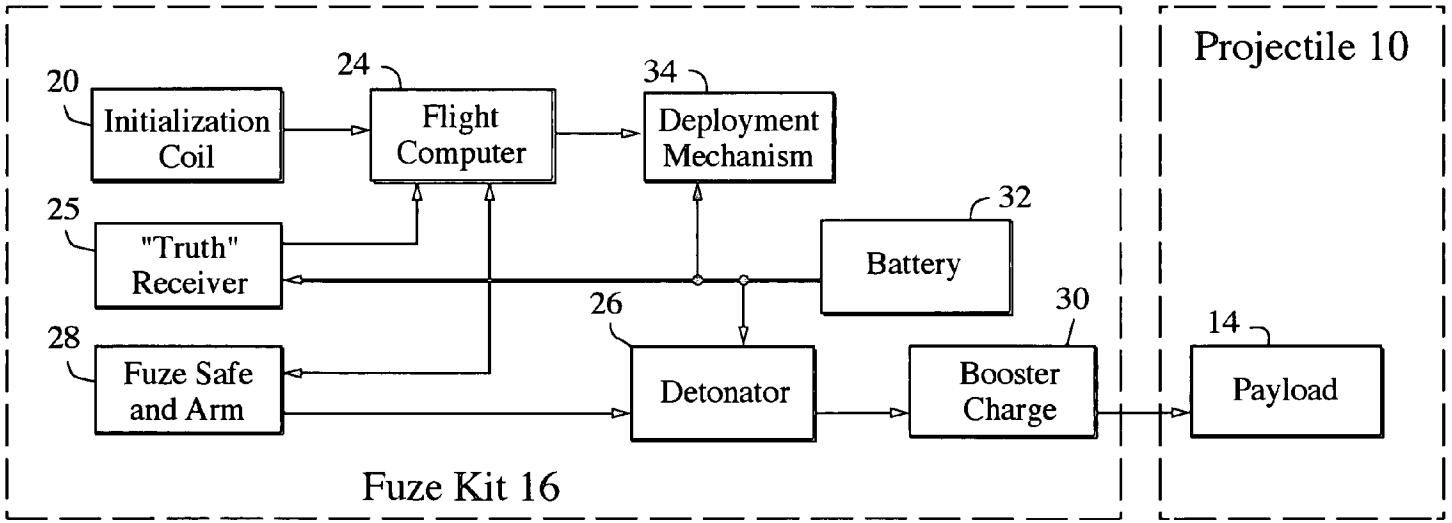
FIG. 3 is a system block diagram of the modified fuze kit.

In an exemplary embodiment, the deployment mechanism 34 includes a voice coil 36 and surface forcing magnets 38 on the canards. The flight computer 24 alternately generates command signals that energizes voice coil 36 thereby creating an electromagnetic field that interacts with the surface forcing magnet's permanent magnetic fields to produce a repulsive force that drives the canards outward to a deployed position as shown in FIG. 2*b* and then produces an attractive force that pulls the canards inward to a stowed position as shown in FIG. 2*a*. Other mechanism such as hydraulic, pneumatic or combination thereof may be employed to deploy the canards. The voice coil mechanism is particularly attractive because it provides both the precise control required to intermittently deploy and store the canards and the efficiency required to operate on a tight power budget. The canards may be moved between deployed and stowed positions or may be deployed proportionally to change the amount of force to the projectile.

To further enhance power efficiency, the deployment mechanism 34 may include a centripetal spring 40 that balances the centrifugal force on the canards caused by rotation of the projectile. Without the spring the voice coil 36 would have to remain energized to produce an attractive force to prevent the canards from deploying, which would be very in efficient. However, the centrifugal force decreases as the spin rate is reduced. Consequently, at lower spin rates the voice coil would have to produce a larger repulsive force to overcome the difference between the centripetal spring force and the centrifugal force, again reducing power efficiency. To mitigate this problem, a deployment spring 42 is unlocked when the spin rate falls below a threshold to counter the centripetal spring 40. Ideally, the voice coil 36 should only need to be activated to deploy and stow the canards and then only with sufficient force to accelerate their mass and not to overcome either the centrifugal force or the centripetal spring force.

Figure 4:
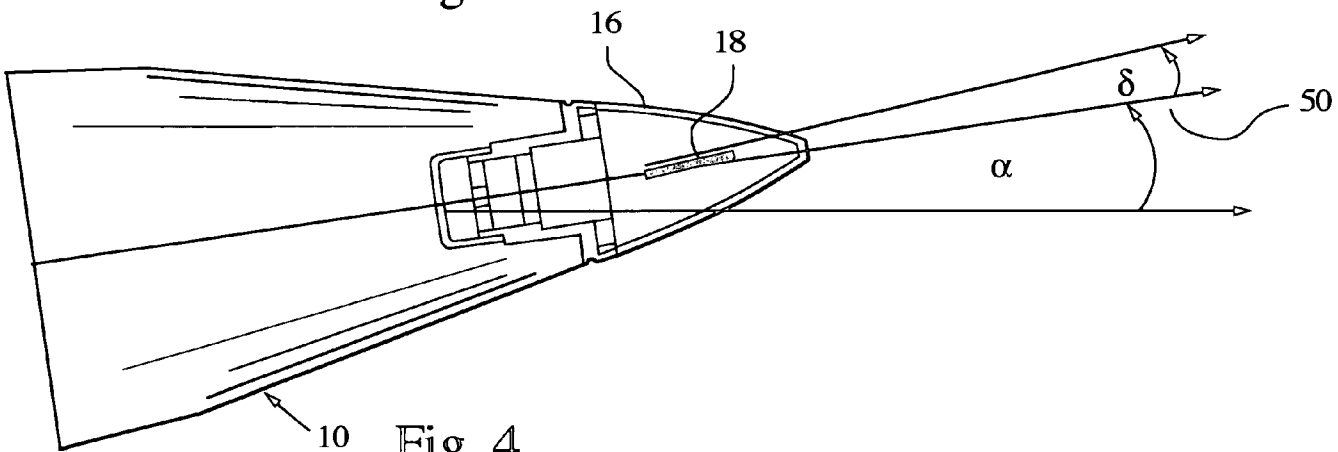
FIG. 4 shows the effective angle of attack of the modified fuze kit and canards when deployed.

As shown in FIG. 4, to generate lift the boresight 50 of the projectile must form an angle of attack a with respect to the wind. Tilting the canards 18 at an angle δcreates an effective angle of attach $\alpha_\delta=\alpha+\delta$ that generates more lift. For simplicity the canard angle δ is suitably fixed although it may be movable to provide another degree of control. Note, because the rotation of the projectile causes an apparent wind angle, lift can be generated even if the canard angle is zero.

As illustrated in FIGS. 5 and 6, the flight computer intermittently deploys and then stows aerodynamic surfaces to develop rotational moments, which create body lift that nudge the projectile in two-dimensions to correct the projectile in its ballistic trajectory. These techniques use the physics of rotating projectiles to their advantage as compared to conventional air-brakes that fight against the physics of ballistic projectiles by creating drag to reduce projectile velocity or slow the roll rate of the projectile. The current technique is more efficient and more precise.

Figure 5A:
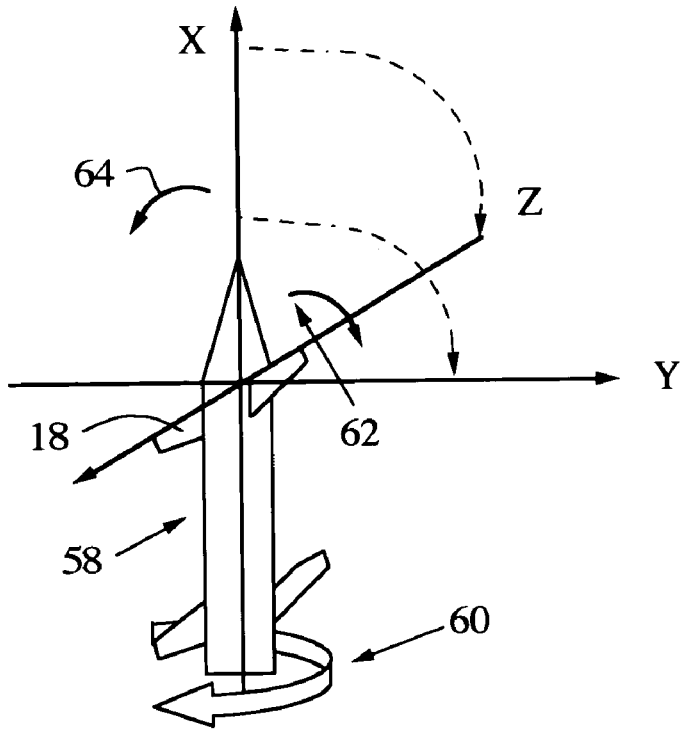
FIGS. 5*a* and 5*b* are moment diagrams that illustrate the reaction of high and low spin rate projectile to the creation of a rotating moment by deployment of a canard.

As shown in FIG. 5*a*, canards 18 are for purposes of illustrating the physics of the control system instantaneously deployed in the XZ plane with the canards (mass m) canted towards the negative Y axis to produce a rotating moment V 60 in the XY plane. A spin stabilized projectile 58 with a high roll rate Ω62 about the X axis will, to a first order approximation, react to the rotating moment 60 in the XY plane by precessing 64 in the XZ plane in response to a coriolis acceleration Fc, i.e. $Fc=-2\ mV\times\Omega$. The command and resulting body angles, $\Phi_{cmd}$ and $\Phi_{body}$, measured with respect to each other and are 0° and 90°, respectively. This is a highly efficient technique because the amount of precession caused by the physics of spinning projectiles is >>100 times larger than the rotating moment. Thus, very quick deployments of the canards can nudge the projectile on to its ballistic trajectory.

Figure 5B:
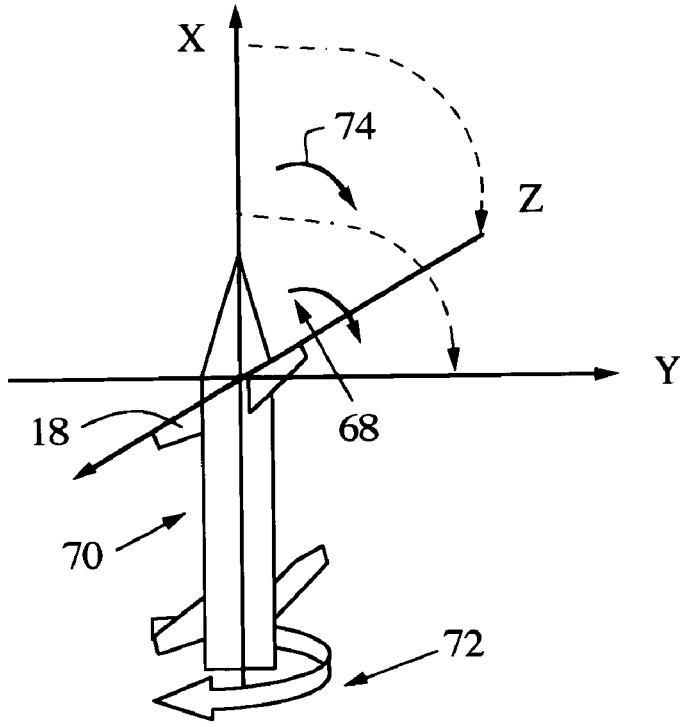

As shown in FIG. 5*b*, canards 18 are for purposes of illustrating the physics of the control system instantaneously deployed in the XZ plane with the canards canted towards the negative Y axis to produce a rotating moment 68 in the XY plane. A fin stabilized projectile 70 with a low roll rate 72 about the X axis will, to a first order approximation, react to the rotating moment 68 in the XY plane by rotating 74 in the XY plane. The command and resulting body angles, $\Phi_{cmd}$ and $\Phi_{body}$, measured with respect to each other and are 0° and 0°, respectively. Although not as efficient as the creation of precession, this approach is still an improvement over conventional air brakes that control the projectile using drag. Thus, very quick deployments of the canards can nudge the projectile on to its ballistic trajectory.

Figure 6A:
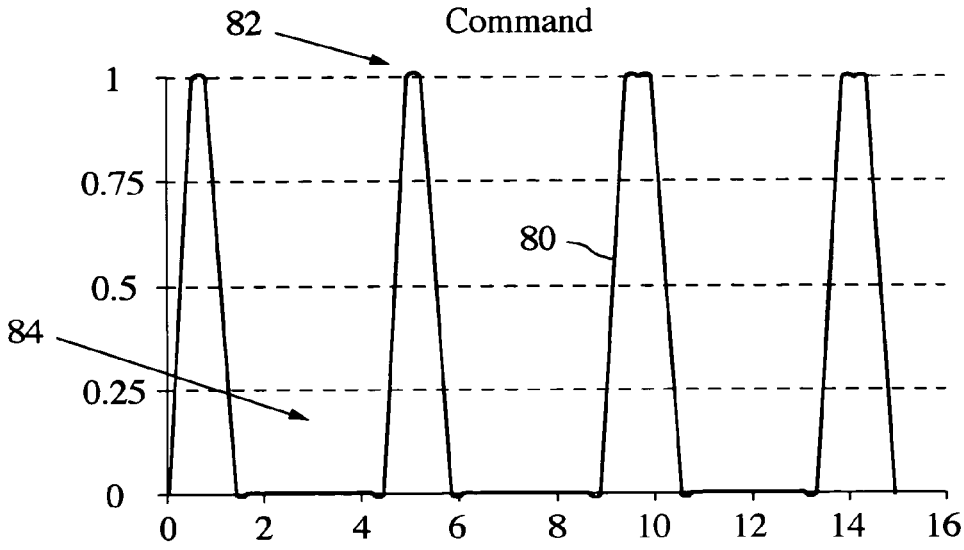
FIGS. 6*a* and 6*b* are plots of a control signal in the time domain and attitude domain.
Figure 6B:
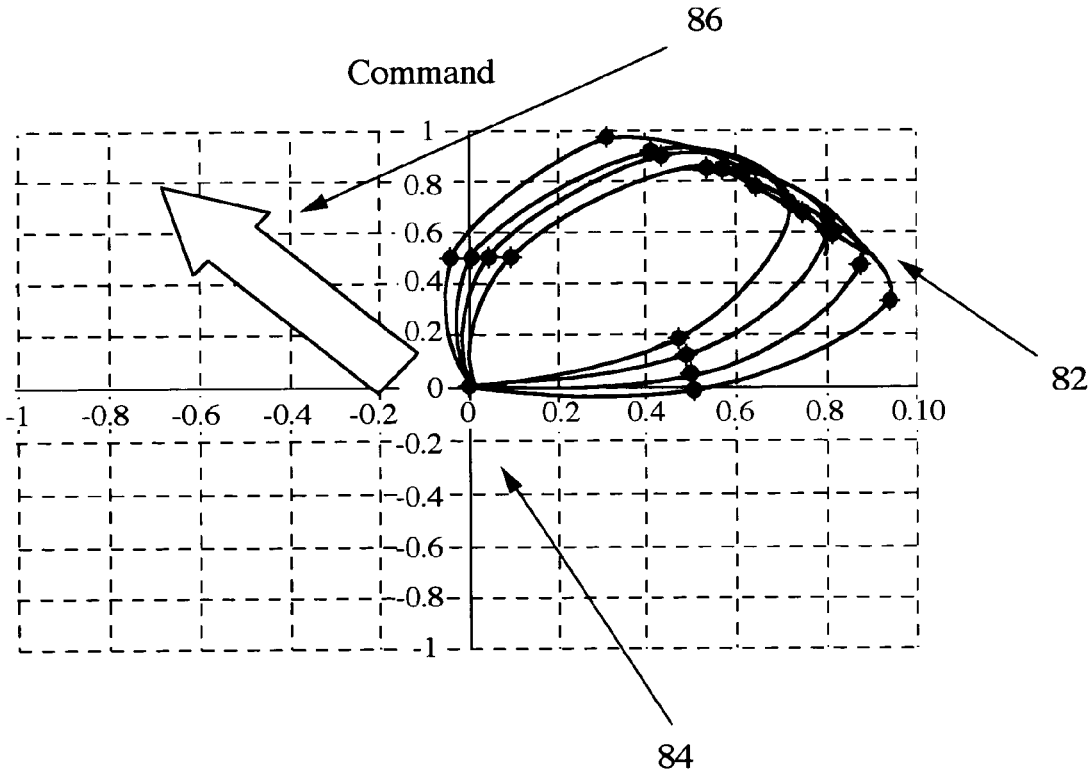

As shown in FIGS. 6*a* and 6*b*, the canards are not and cannot be deployed and stowed instantaneous. In practice, the canards are deployed and stowed over multiple partial roll cycles of the projectile, suitably within a single quadrant, to precess or "nudge" the projectile in the desired direction to correct for downrange or crossrange errors in the projectile's trajectory. Deployment over a full roll cycle would cancel out any precession and simply cause drag. As shown in FIG. 6*a*, the flight computer issues a command signal 80 at a precise time to move the canards to a deployed state 82 and rescinds the command at a precise time to move the canards to a stowed state 84. The flight computer issues the command signal over a plurality of cycles until the projectile is moved to its desired ballistic trajectory at which point the canards are stowed until further correction is required. FIG. 6*a* shows the representation of a stream of the command signals about the roll axis. The signals induce a projectile body motion 86 in a direction normal to the average force.

Figure 7:
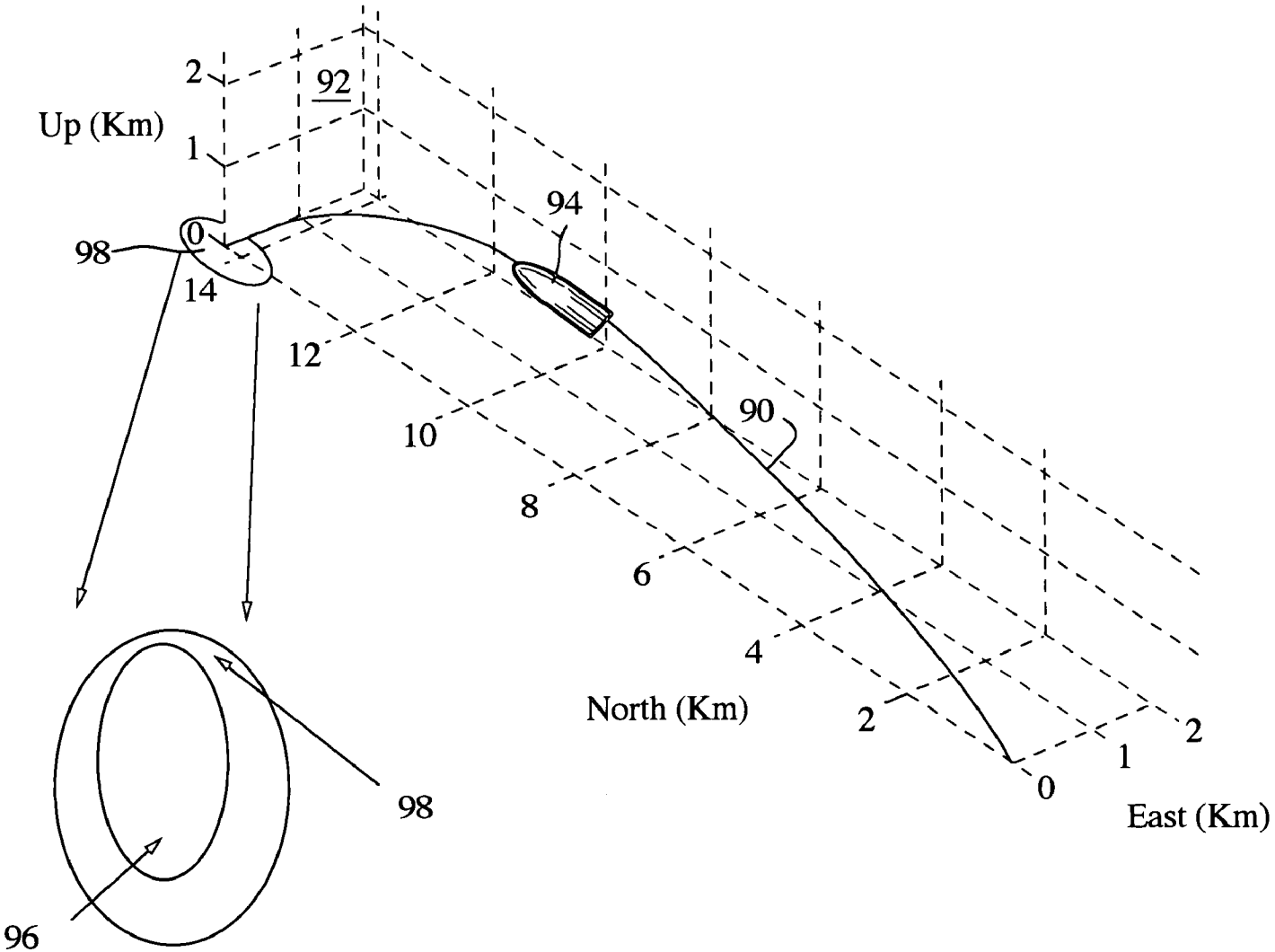
FIG. 7 is a two-dimensional plot of a corrected ballistic trajectory and projectile dispersion.

In order to balance the requirements of full and precise 2D control of the projectile to the target against the reality of a limited power budget, intermittent deployment can be done in a couple ways. A projectile's ballistic trajectory 90 in a base frame 92 is shown in FIG. 7. The projectile 94 is fired in accordance with a standard firing table for that projectile, range, wind conditions etc. Note, that high spin rate projectiles that rotate in a clockwise direction will naturally precess to the right so they must be aimed to the left of the target. As illustrated, the projectile's ballistic trajectory 90 will have a statistical dispersion 96, typically +/−150 m downrange and +/−50 m crossrange for a 14 Km launch, based on variations in the projectiles, firing conditions, and changes in wind and other atmospherics. To use the existing firing tables, the 2D control mechanism must be (a) able to adjust in all four directions and (b) able to provide a total guidance correction 98 that encompasses the projectile dispersion 96.

Figure 8:
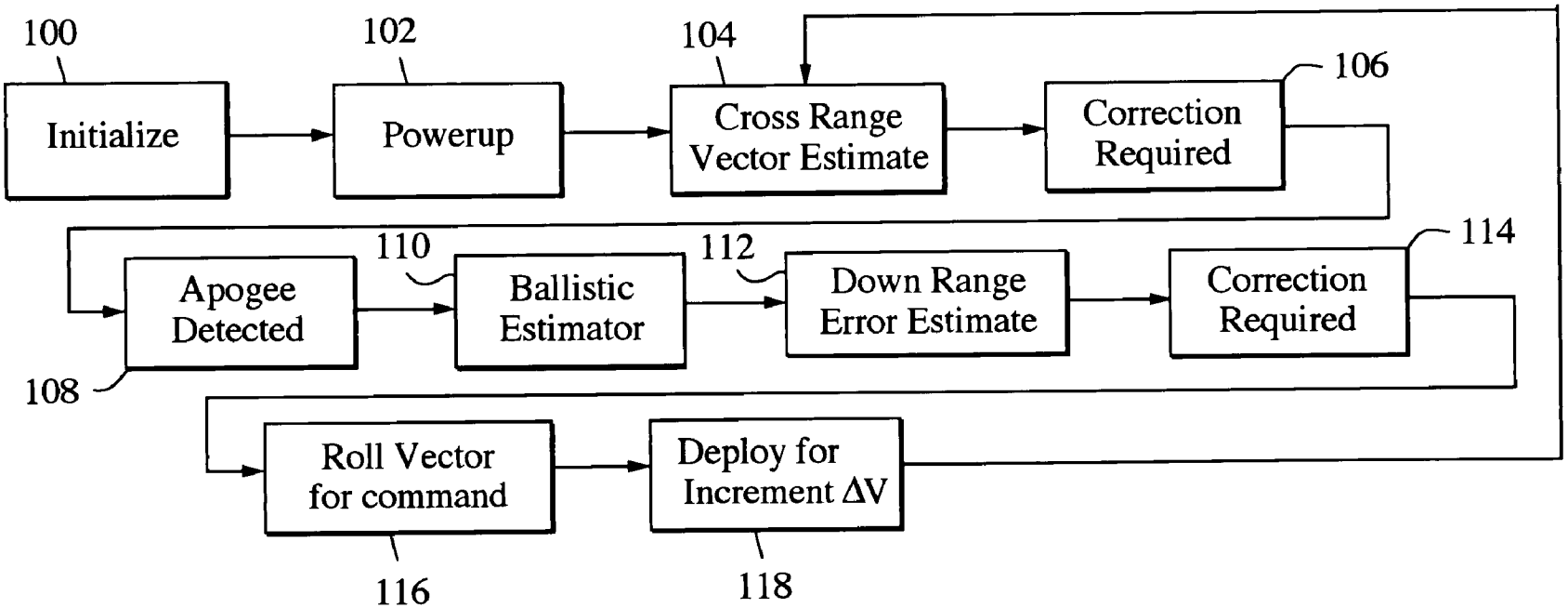
FIG. 8 is a flowchart illustrating the use of the 2-D corrector system.

FIG. 8 illustrates an exemplary control sequence that the flight computer 24 may execute to intermittently deploy the canard(s) to nudge the projectile to its ballistic trajectory. The flight computer is initialized (step 100) to load mission data and is powered up (step 102) from the battery when fired from the cannon. Shortly after launch, the flight computer makes a cross range vector estimate (step 104) by comparing the projectile's current position and attitude provided by, for example, a GPS/IMU system to the target coordinates in accordance with the firing table and determines whether correction is required (step 106). The flight computer checks to determine whether apogee has been detected (step 108). If so, the computer estimates the range based on current ballistic trajectory (step 110), calculates a down range error estimate (step 112), and determines whether correction is required (step 114). The computer generates the appropriate roll vector for command to cause the desired precessed body motion (step 116) and then controls the canards to deploy for an increment ΔV, typically in one quadrant, starting at a precise time (step 118) to nudge the projectile back towards its ballistic trajectory. The canards are deployed repeatedly until the projectile is back on its trajectory. If apogee is not detected, the computer controls the canards just to compensate for crossrange errors.

Figure 9A:
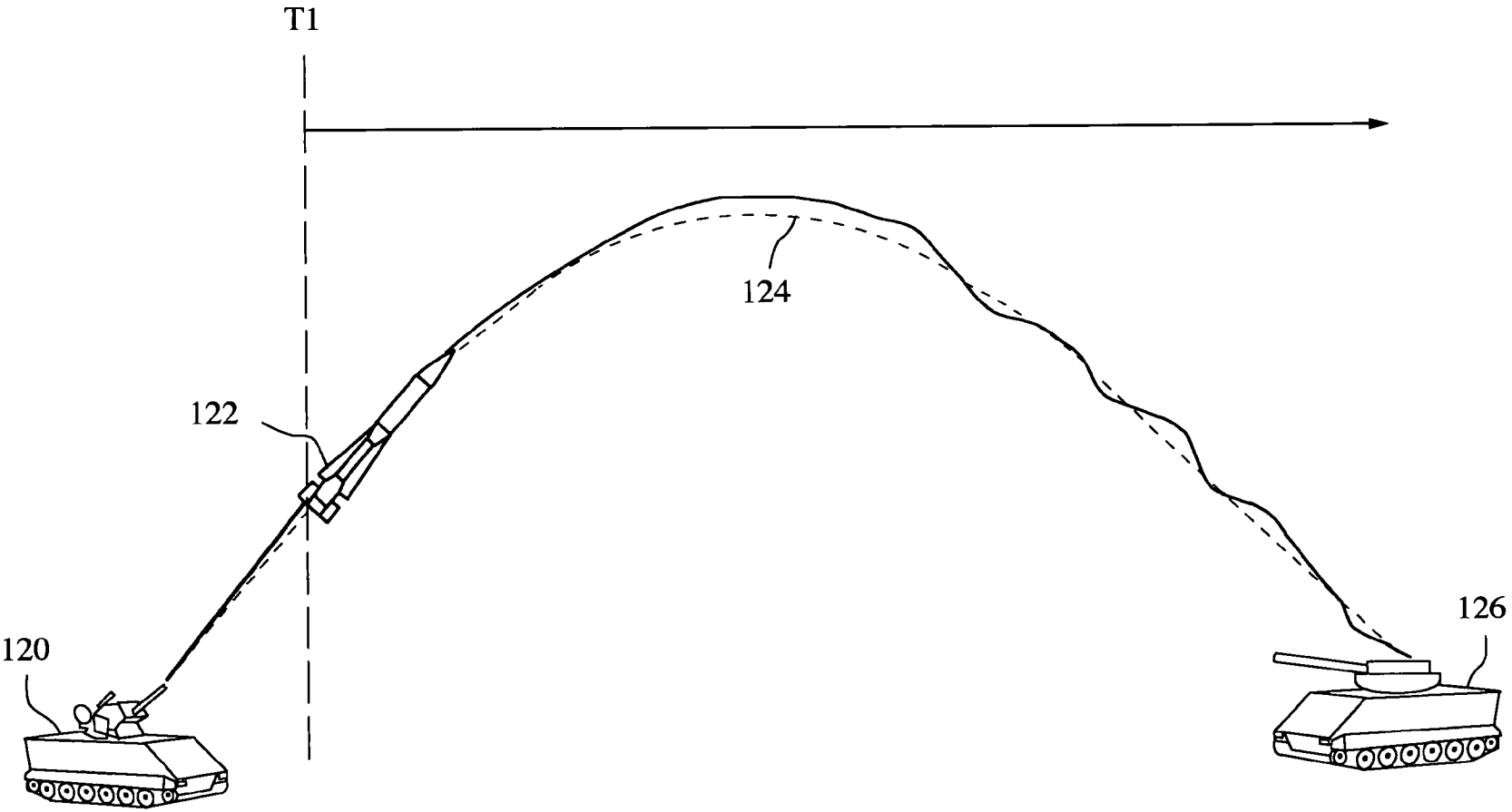
FIGS. 9*a* and 9*b* are plots of a projectile's 2-D corrected ballistic trajectory using continuous-to-target and windowed-to-target control.
Figure 9B:
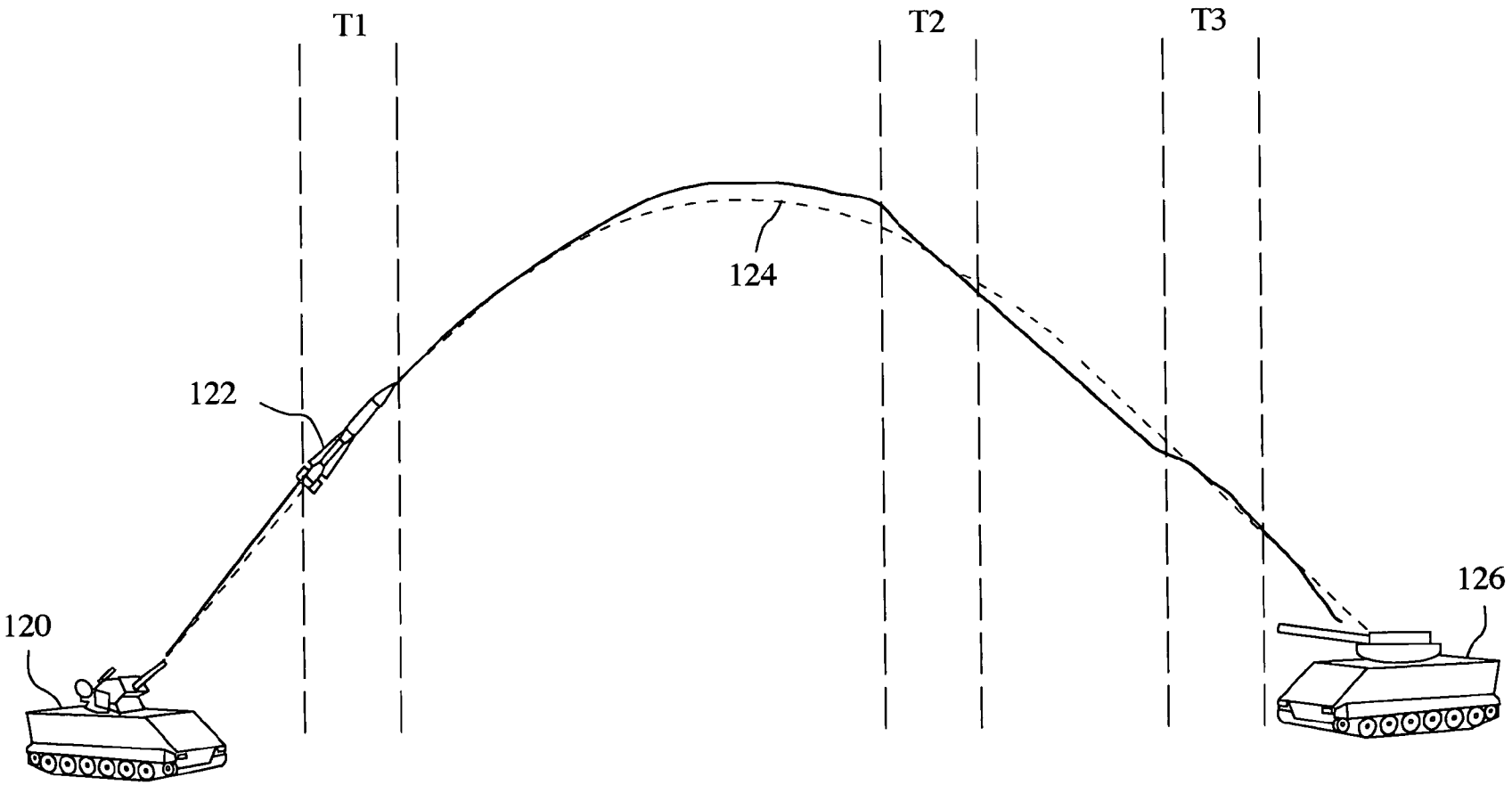

As shown in FIG. 9*a*, a weapons system 120 launches a projectile 122 on a ballistic trajectory 124 according to an existing firing table towards a target 126. The flight computer is powered up at a time T1 immediately after launch and maintains continuous control throughout the rest of the flight until the projectile impacts the target. This approach provides maximum control but does require continuous power to determine and make any necessary corrections. Alternately, as shown in FIG. 9*b*, the flight computer may be powered up shortly after launch for a time increment ΔT1 to make initial adjustments for crossrange variations, again after apogee at a time increment ΔT2 to make initial corrections for downrange variations and then once again (or more) at a certain time to target for a time increment ΔT3. This approach should provide adequate control and will use less power.

Figure 10A:
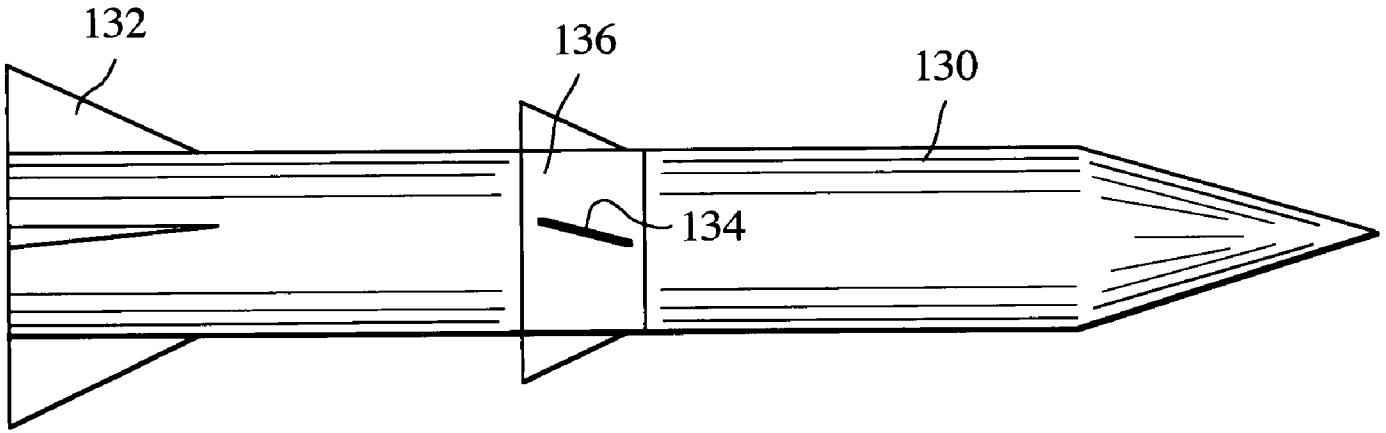
FIGS. 10*a* and 10*b* are diagrams of a 2-D corrector system implemented as mid-body wings and tail fins.
Figure 10B:
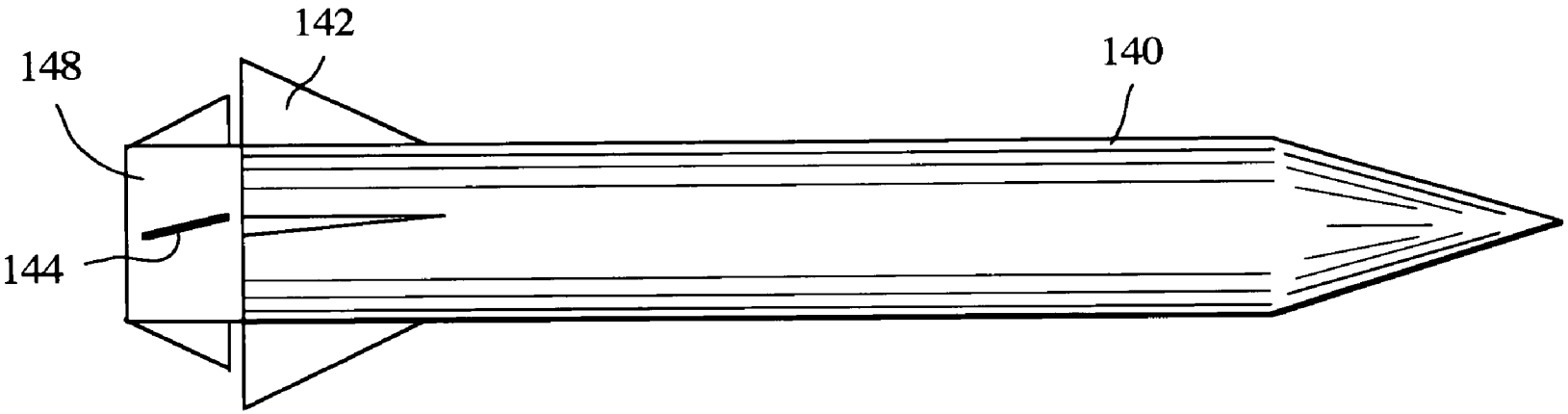

Although the 2-D corrector system has been described in detail with reference to spin stabilized projectiles and specifically designed into a modified fuze kit, it is equally applicable to missiles, EKVs and other fin-stabilized weapons systems. As shown in FIG. 10*a*, an airframe 130 has tail fins 132 that provide stabilization. In this case, the kit deploys the surfaces as wings 134 in a mid-body assembly 136 to provide correction. As shown in FIG. 10*b*, an airframe 140 has tail fins 142 that provide stabilization. In this case, the kit implements the surfaces as fins 144 in a tail assembly 146 to provide correction.

While several illustrative embodiments of the invention have been shown and described, numerous variations and alternate embodiments will occur to those skilled in the art. For example, although the invention has been described in the context of a "body fixed" fuze kit it could also be implemented in a decoupled configuration. Such variations and alternate embodiments are contemplated, and can be made without departing from the spirit and scope of the invention as defined in the appended claims.

We claim:

1. A method for correcting the range and deflection errors in an unguided spin or fin stabilized spinning projectile, comprising:

determining deviations of the spinning projectile from a desired ballistic trajectory in a downrange dimension and a crossrange dimension; and repeatedly deploying and stowing at least one aerodynamic surface on the spinning projectile forming partial roll cycles that develop a sequence of rotational moments, said spinning projectile's gyroscopic inertia reacting to said sequence of rotational moments to cause a precession of the projectile at a angle to the plane of the average rotational moment creating body lift that iteratively nudges the spinning projectile in said crossrange and downrange dimensions to move the projectile to its desired ballistic trajectory.

2. The method of claim 1, wherein the aerodynamic surface is deployed and stowed within one roll cycle of the projectile to form the partial roll cycle.

3. The method of claim 1, wherein the projectile has a low spin rate so that the projectile precesses in the same plane as the average rotational moment.

4. The method of claim 1, wherein the projectile has a high spin rate so that the projectile precesses in a plane orthogonal to the average rotational moment.

5. The method of claim 1, further comprising:

launching the spin stabilized projectile on the ballistic trajectory according to a firing table for the same unguided projectile.

6. The method of claim 1, wherein the aerodynamic surface has no effect on the ballistic trajectory of the projectile when stowed.

7. The method of claim 1, wherein the aerodynamic surface is deployed at a fixed angle of attack in a predetermined fully deployed position.

8. The method of claim 1, wherein the aerodynamic surface is moved between only a fully deployed position and a stowed position.

9. The method of claim 1, wherein the determination of deviations from the ballistic trajectory and the intermittent deployment of the aerodynamic surface are continuous-to-target.

10. The method of claim 1, wherein the determination of deviations from the ballistic trajectory and the intermittent deployment of the aerodynamic surface are windowed-to-target.

11. The method of claim 10, wherein the aerodynamic surface is repeatedly deployed and stowed in a first window soon after launch to correct for deviations in the crossrange dimension, in a second window soon after the projectile passes apogee to correct for deviations in the downrange dimension, and in a third window at a time-to-target to correct for deviations in the crossrange and downrange dimensions.

12. The method of claim 1, wherein the aerodynamic surface is deployed and stowed by energizing a voice coil.

13. A 2-D corrector for correcting the range and deflection errors in an unguided spin or fin stabilized spinning projectile; comprising:

at least one aerodynamic surface on the projectile moveable between stowed and deployed positions;

a deployment mechanism for moving the aerodynamic surface between said stowed and deployed positions;

a receiver for receiving the position of the projectile; and a flight computer that determines deviations from a ballistic trajectory in a downrange dimension and a crossrange dimension and controls the deployment mechanism to repeatedly deploy and stow the at least one aerodynamic surface on the spinning projectile forming partial roll cycles that develop a sequence of rotational moments, said spinning projectile's gyroscopic inertia reacting to said sequence of rotational moments to cause a precession of the projectile at an angle to the plane of the average rotational moment creating body lift that iteratively nudges the spinning projectile in said crossrange and downrange dimensions to move the projectile to its ballistic trajectory.

14. The 2-D corrector of claim 13, wherein said at least one aerodynamic surface includes a pair of pivot mounted canards.

15. The 2-D corrector of claim 13, wherein the aerodynamic surface has no effect on the ballistic trajectory of the projectile when stowed.

16. The 2-D corrector or claim 13, wherein the aerodynamic surface is deployed at a fixed angle of attack.

17. The 2-D corrector of claim 13, wherein the aerodynamic surface is moved between a fully deployed position and a stowed position.

18. The 2-D corrector of claim 13, wherein the deployment mechanism comprises:

A voice coil, and

A permanent magnet on each of said at least one aerodynamic surface.

19. The 2-D corrector of claim 18, wherein the deployment mechanism further comprises a centripetal spring that substantially offsets a centrifugal force on the aerodynamic surface caused by the rotation of the projectile.

20. The 2-D corrector of claim 19, wherein the deployment mechanism further comprises a deployment spring that is unlocked if the rotation of the projectile falls below a predetermined rate to partially offset the centripetal spring force.

21. The 2-D corrector of claim 13, wherein the aerodynamic surface, deployment mechanism, receiver and flight computer are integrated in a fuze kit for use with a projectile.

22. The 2-D corrector of claim 13, wherein the aerodynamic surface is deployed and stowed within one roll cycle of the projectile to form the partial roll cycle.

23. The 2-D corrector of claim 13, wherein the projectile has a low spin rate so that the projectile precesses in the same plane as the average rotational moment.

24. The 2-D corrector of claim 13, wherein the projectile has a high spin rate so that the projectile precesses in a plane orthogonal to the average rotational moment.

25. The 2-D corrector of claim 13, wherein the spin stabilized projectile is launched on the ballistic trajectory according to a firing table for the same unguided projectile.

26. The 2-D corrector of claim 13, wherein the flight computer determines deviations from the ballistic trajectory and repeatedly deploys and stows the aerodynamic surface continuous-to-target.

27. The 2-D corrector 13, wherein the flight computer determines deviations from the ballistic trajectory and repeatedly deploys and stows the aerodynamic surface windowed-to-target.

28. The 2-D corrector of claim 27, wherein the aerodynamic surface is repeatedly deployed and stowed in a first window soon after launch to correct for deviations in the crossrange dimension, in a second window soon after the projectile passes apogee to correct for deviations in the downrange dimension, and in a third window at a time-to-target to correct for deviations in the crossrange and downrange dimensions.

29. A modified fuze kit for use with a spin or fin stabilized spinning projectile, comprising:

a fuze kit;

at least one aerodynamic surface on the fuze kit moveable between stowed and deployed positions;

a deployment mechanism for moving the aerodynamic surface between said stowed and deployed positions;

a receiver for receiving the position of the projectile; and a flight computer that determines deviations from a ballistic trajectory in a downrange dimension and a crossrange dimension and controls the deployment mechanism to repeatedly deploy and stow the at least one aerodynamic surface on the spinning projectile forming partial roll cycles that develop a sequence of rotational moments, said spinning projectile's gyroscopic inertia reacting to said sequence of rotational moments to cause a precession of the projectile at an angle to the plane of the average rotational moment creating body lift that iteratively nudges the spinning projectile in said crossrange and downrange dimensions to move the projectile to its ballistic trajectory.

30. The modified fuze kit of claim 29, wherein the aerodynamic surface is deployed at a fixed angle of attack.

31. The modified fuze kit of claim 29, wherein the deployment mechanism comprises:

A voice coil, and

A permanent magnet on each of said at least one aerodynamic surface.

32. The modified fuze kit of claim 31, wherein the deployment mechanism further comprises a centripetal spring that substantially offsets a centrifugal force on the aerodynamic surface caused by the rotation of the projectile.

33. The modified fuze kit of claim 32, wherein the deployment mechanism further comprises a deployment spring that is unlocked if the rotation of the projectile falls below a predetermined rate to partially offset the centripetal spring force.

34. The modified fuze kit of claim 29, wherein the aerodynamic surface is deployed and stowed within one roll cycle of the projectile to form the partial roll cycle.

35. The modified fuze kit of claim 29, wherein the projectile has a low spin rate so that the projectile precesses in the same plane as the average rotational moment.

36. The modified fuze kit of claim 29, wherein the projectile has a high spin rate so that the projectile precesses in a plane orthogonal to the average rotational moment.

37. The modified fuze kit of claim 29, wherein the flight computer determines deviations from the ballistic trajectory and repeatedly deploys and stows the aerodynamic surface continuous-to-target.

38. The modified fuze kit of claim 29, wherein the flight computer determines deviations from the ballistic trajectory and repeatedly deploys and stows the aerodynamic surface windowed-to-target.

39. The modified fuze kit claim 38, wherein the aerodynamic surface is repeatedly deployed and stowed in a first window soon after launch to correct for deviations in the crossrange dimension, in a second window soon after the projectile passes apogee to correct for deviations in the downrange dimension, and in a third window at a time-to-target to correct for deviations in the crossrange and downrange dimensions.

40. The method of claim 12, wherein a centripetal spring substantially offsets a centrifugal force on the at least one said aerodynamic surface caused by the rotation of the projectile.

41. A method for correcting the range and deflection errors in an unguided spin or fin stabilized spinning projectile, comprising:

determining deviations of the spinning projectile from a desired ballistic trajectory in a downrange dimension and a crossrange dimension;

energizing a voice coil to intermittently deploy and stow at least one aerodynamic surface on the spinning projectile to develop a rotational moment, said spinning projectile reacting to said rotational moment to create body lift that nudges the spinning projectile in said crossrange and downrange dimensions to move the projectile to its desired ballistic trajectory;

using a centripetal spring to substantially offset a centrifugal force on the at least one said aerodynamic surface caused by the rotation of the projectile; and unlocking a deployment spring if the rotation of the projectile falls below a predetermined rate to partially offset the centripetal spring force.

42. The method of claim 1, wherein the at least one aerodynamic surface is deployed at precise on positions in each roll cycle and stowed at precise off positions in each roll cycle to develop the rotational moment.

43. The method of claim 1, wherein the at least one aerodynamic surface is deployed within a single quadrant of each roll cycle.

* * * * *